US007232147B2

(12) United States Patent
Couderc

(10) Patent No.: US 7,232,147 B2
(45) Date of Patent: Jun. 19, 2007

(54) DEVICE FOR RETAINING A FOOT OR A BOOT ON A SPORTS APPARATUS

(75) Inventor: Bernard Couderc, Annecy (FR)

(73) Assignee: Salomon S.A., Metz-Tessy (FR)

( * ) Notice: Subject to any disclaimer, the term of this patent is extended or adjusted under 35 U.S.C. 154(b) by 103 days.

(21) Appl. No.: 10/929,367

(22) Filed: Aug. 31, 2004

(65) Prior Publication Data

US 2005/0046150 A1 Mar. 3, 2005

(30) Foreign Application Priority Data

Sep. 2, 2003 (FR) ..... 03 10366

(51) Int. Cl.
*A63C 9/00* (2006.01)

(52) U.S. Cl. ..... 280/623; 280/611; 280/633

(58) Field of Classification Search ..... 280/611, 280/617, 619, 620, 621, 633, 623
See application file for complete search history.

(56) References Cited

U.S. PATENT DOCUMENTS 5,713,587 A 2/1998 Morrow et al. ..... 280/14.2
5,727,797 A * 3/1998 Bowles ..... 280/14.21
5,771,609 A 6/1998 Messmer ..... 36/89
5,967,531 A * 10/1999 Saillet ..... 280/11.36
6,065,770 A * 5/2000 Hansen et al. ..... 280/617
6,116,634 A * 9/2000 Mometti ..... 280/613
6,206,403 B1 3/2001 Black et al. ..... 280/618
6,276,708 B1 8/2001 Hogstedt ..... 280/613
6,511,091 B1 * 1/2003 Su et al. ..... 280/617
6,581,944 B1 * 6/2003 Marmonier et al. ..... 280/14.22
6,631,919 B1 * 10/2003 West et al. ..... 280/633
6,648,365 B1 * 11/2003 Laughlin et al. ..... 280/624
6,889,997 B2 * 5/2005 Okajima ..... 280/625
6,974,149 B2 * 12/2005 Naito et al. ..... 280/611

* cited by examiner

*Primary Examiner*—Christopher P. Ellis
*Assistant Examiner*—John Walters
(74) *Attorney, Agent, or Firm*—Greenblum & Bernstein, P.L.C.

(57) ABSTRACT

A device for retaining a foot or boot on an apparatus, such as a binding for a snowboard. The device has a lateral portion and a medial portion demarcating a receiving zone, a rear support element, and a linkage. The linkage includes a front part and a rear part. The front part is located nearer a support surface of the rear support element and the rear part is located nearer a free surface of the rear support element.

14 Claims, 9 Drawing Sheets

51
86
67
64
52
81
72
69
85
73
83
84
70
87
63
65
71
82
68
80
66
61
60
25
24
20
26
27
53
62

120
126
140
141
146
125
142
146
122
128
121
143
124

DEVICE FOR RETAINING A FOOT OR A BOOT ON A SPORTS APPARATUS

CROSS-REFERENCE TO RELATED APPLICATION

This application is based upon French Patent Application No. 03.10366, filed Sep. 2, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to a device for retaining a foot or a boot on a sports apparatus, in which the retention of the foot or boot is accomplished by means of at least one strap or linkage. The invention also relates to a strap or linkage adapted to be integral with the device.

2. Description of Background and Relevant Information

Devices of the aforementioned type are used for snowboarding, snow skiing, water skiing, snowshoeing, roller skating, surfing, and other activities.

A device using straps/linkages according to the prior art generally has a lateral portion and a medial portion which demarcate therebetween a zone for receiving the foot or the boot, as well as a rear support element, or highback, associated with at least one of the lateral and medial portions. The rear support element has a support surface facing the receiving zone and adapted to receive the rear of a lower leg of the user. The rear support element also has a free surface opposite the support surface. The device also has at least one linkage that extends between the lateral and medial portions, each linkage being used to retain the foot or the boot in the receiving zone.

The linkage is generally an elongated piece that is relatively flexible and substantially inextensible. Its flexibility enables it to adapt to the foot or to the boot. Its relative inextensibility promotes the retention of the foot or of the boot in the receiving zone.

Two linkages are frequently used on a device, one in the area of the metatarsophalangeal joint of the foot, the other in the area of the instep. The one which acts toward the instep is generally oriented so as to bias the foot or the boot toward both the receiving zone and the rear support element.

That is the case, for example, in snowboarding where a user must be supported at the rear. By having the lower leg in constant contact with the rear support element, steering precision can be assured.

However, it has been recognized that the retention of the heel in known devices is not always adequate, and that play can be created beneath the heel of the foot or boot. The application of forces in steering the apparatus, such as a snowboard, can induce heel movement.

For example, in snowboarding, a setting of the front running edge can cause the heel to be raised, which hinders steering precision.

In order to improve the retention of the heel, the prior art has proposed solutions.

One of these solutions, according to U.S. Pat. No. 6,206,403, involves using a linkage device, in the area of the heel, which has a front strap part and a rear strap part. The front strap is at the front of the lower leg and substantially above the instep, whereas the rear strap is at the rear of the lower leg and above the heel. The front and rear parts are joined to encircle the lower leg just above the heel. When the belt formed by the parts of the linkage device is properly tightened, the heel is retained with precision in the receiving zone. Thus, the amount of play created beneath the heel of the foot or the boot is reduced. However, it has been noted that a substantial amount of movement is formed between the rear of the lower leg and the rear support element. The movement hinders the support provided at the rear.

This is particularly the case in snowboarding when the user exerts supporting forces on the rear running edge. The leg extension movement is disturbed by the elimination of the aforementioned play. This hinders steering precision.

Thus, the device according to the document U.S. Pat. No. 6,206,403 improves the holding of the foot or boot beneath the heel, but it worsens it between the rear of the lower leg and the rear support element, which is an advantage, on the one hand, and a drawback, on the other hand.

SUMMARY OF THE INVENTION

In view of the foregoing description, an object of the invention is to remedy the aforementioned drawbacks and, in particular, to improve the retention of the foot or boot in the area of the heel, and simultaneously to improve the retention of the rear of the lower leg on the rear support element.

To this end, the invention proposes a device for retaining a foot or boot, the device having a lateral portion and a medial portion demarcating a zone for receiving the foot or boot, as well as a rear support element associated at least with one of the lateral and medial portions, the rear support element having a support surface facing the receiving zone as well as a free surface opposite the support surface, the device further having a linkage that extends between the lateral and medial portions, the linkage having a front section or part and a rear section or part.

The front part of the retaining device according to the invention is located nearer the support surface of the rear support element (i.e., forward of the rear support element), and the rear part is located nearer the free surface of the rear support element (i.e., rearward of the rear support element).

Thus, at the same time as it encircles the lower leg right above the heel, the linkage presses the rear of the lower leg against the rear support element. As a result, it allows the retention, with small or even non-existent play, of the heel in the receiving zone as well as of the rear of the lower leg against the rear support element. As a result, for the rear of the foot or of the boot, the holding precision is distributed in an even, or uniform, manner. A resulting advantage is a great steering precision under all circumstances.

BRIEF DESCRIPTION OF DRAWINGS

Other characteristics and advantages of the invention will be better understood by means of the following description, with reference to the attached drawings showing, by way of non-limiting examples, how the invention can be embodied, and in which.

DETAILED DESCRIPTION OF THE INVENTION

Although the examples described hereinafter relate more particularly to the field of snowboarding, it is to be understood that they also apply to other fields as mentioned above.

An example of a first embodiment of the invention is shown in FIGS. 1–5.

Figure 1:
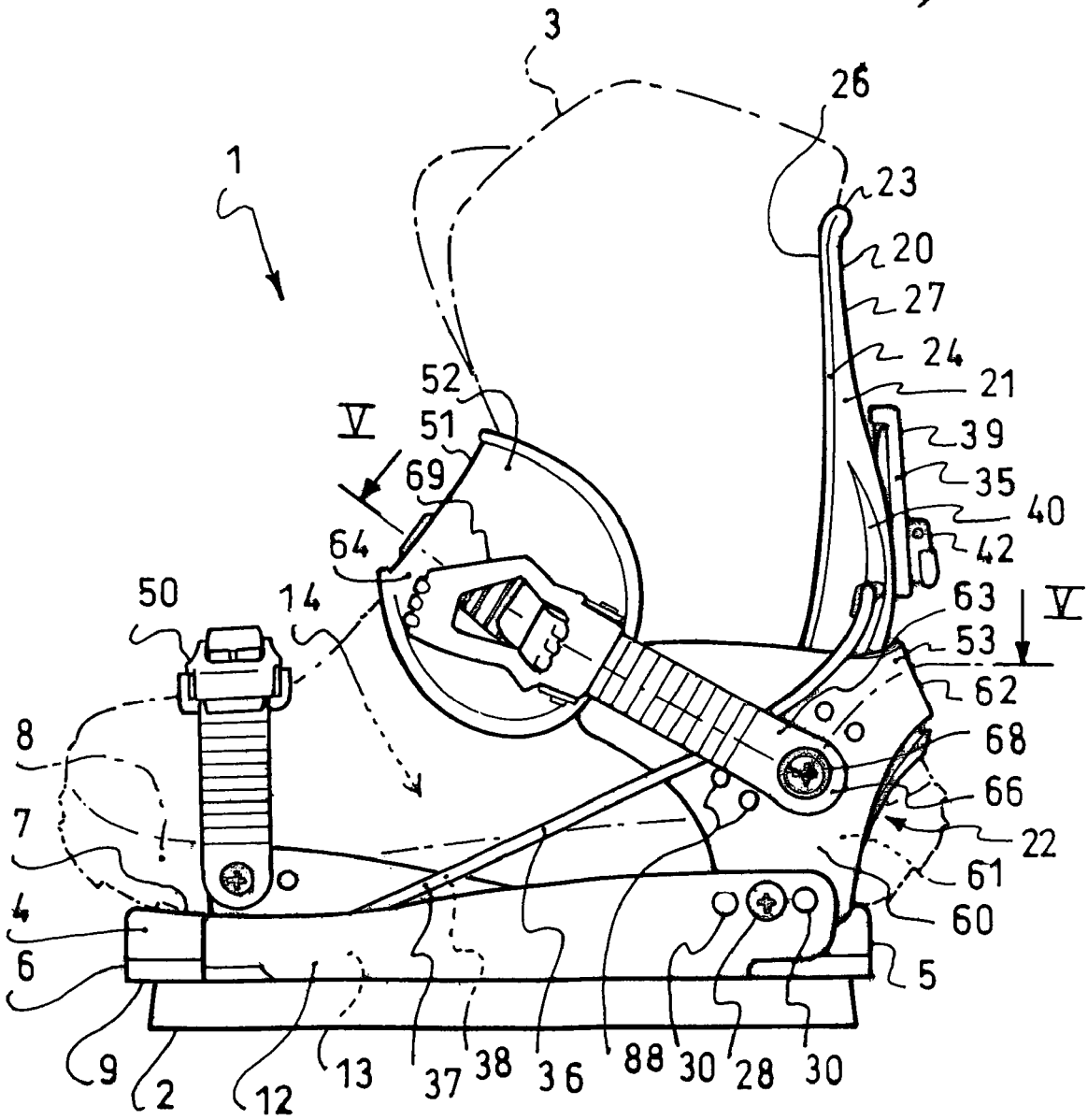
FIG. 1 is a side view of a retaining device according to a first embodiment of the invention.

As seen in FIG. 1, a retaining device 1, or binding, allows for the temporary retention of a boot 3 on a board 2.

As known, the retaining device 1 has a base 4 that extends longitudinally between a rear end 5 and a front end 6.

The base 4 has an upper surface 7 provided to be opposite the sole 8 of the boot 3, and a lower surface 9 provided to be above the board 2.

Figure 2:
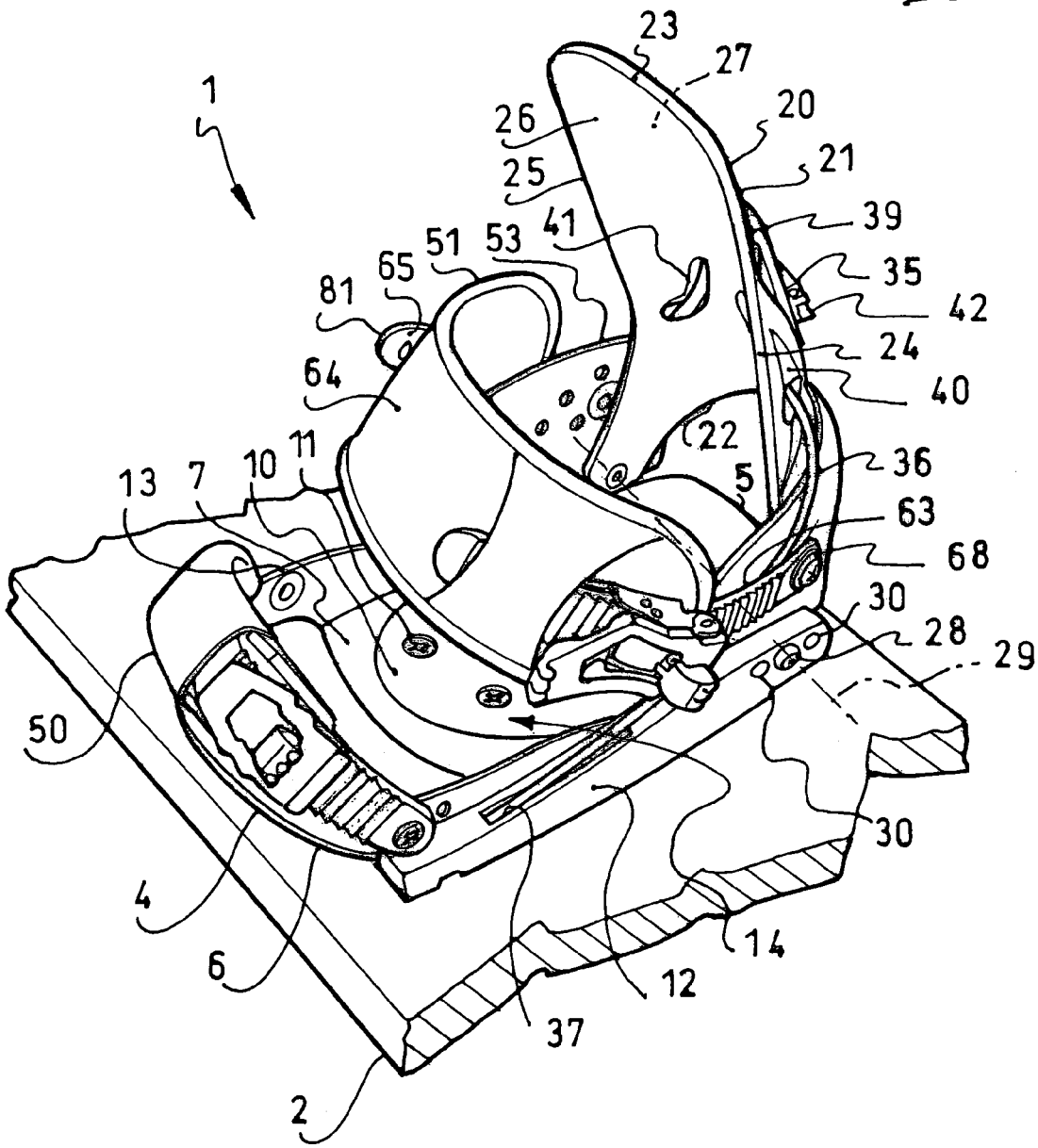
FIG. 2 is a perspective view of the device of FIG. 1.

As seen in FIG. 2, the base 4 is retained on the board 2 by a means shown in the form of a disk 10, which is itself retained on the board 2 by screws 11.

Other mechanisms could be used, alternatively, or in addition, to retain the base 4 on the board.

The base 4 is transversely bordered by a lateral flange 12 and a medial flange 13. Each of the flanges 12, 13 forms a lateral or medial portion, respectively, of the device 1 so as to demarcate a zone 14 for receiving the boot. When a boot is positioned on the device 1, the flanges 12, 13 extend along the respective sides of the sole 8. A structure other than the flanges 12, 13 could be provided to form the lateral and medial portions. For example, mere lateral and medial abutments could be used.

It is contemplated, according to the invention, that the base 4 and the flanges 12, 13 could be made in the form of a unitary piece constructed, for example, of a synthetic material. However, one could provide for the flanges to be pieces that are affixed to the base by any means, such as adhesive or glue, welding, screws, and/or nesting, for example.

The device 1 also has a rear support element or highback 20, so that the user can be supported at the rear by means of the lower leg.

The rear support element 20 has a curved plate 21 that extends longitudinally between a fastening end 22 and a free end 23, transversely between a lateral edge 24 and a medial edge 25, and in thickness between a support surface 26 and a free surface 27.

The support surface 26 is provided to receive the rear of the user's lower leg, the rear support element 20 and the base 4 consequently being associated. According to the first embodiment of the invention, the rear support element 20 is associated with the flanges 12, 13, for example, by means of an articulation 28, or pivot mechanism. The articulation is oriented substantially along a transverse axis 29 of the device 1. The articulation 28 can include any component, such as a screw, a rivet, a washer, a nut, a pin, or the like.

The articulation 28 allows a movement that brings the rear support element 20 closer to the base 4, such as by substantially collapsing above the base 4. A resulting advantage is to facilitate the storage of the device 1.

The rear support element 20 could also be associated directly with the base 4. It could also be provided that the rear support element 20 be affixed directly to the apparatus, in this case the board 2. It suffices to position it on the apparatus for it to allow transmission of the rear support forces with the lower leg.

Furthermore, a means for adjusting the position of the rear support element 20 in relation to the base 4 is provided. This means is shown in the form of holes 30 provided in the lateral 12 and medial 13 flanges. For example, it is possible to move the rear support element 20 forward or backward along the length of the base 4, by dismounting and then remounting the articulation 28. This makes it possible to adjust the device 1 to the length of a boot. The holes 30 could be arranged so as to allow an adjustment in height, in a direction coming closer to or moving away from the base 4.

Adjustment means other than the holes 30 could be provided. For example, one could provide slits or grooves.

According to a first embodiment of the invention, an abutment 35 limits the rearward rotation of the rear support element 20.

In a non-limiting fashion, the abutment 35 has a cable 36 that extends around the rear support element 20. The path of the cable 36 can be seen in FIGS. 1, 2, and 3. For example, the cable can have a lateral end 37 and a medial end 38. Each of the ends 37, 38 is affixed to the lateral 12 or medial 13 flange by any means known to one with ordinary skill in the art. The use of a crimped end piece can be suitable. Each end 37, 38 is affixed to the flange 12, 13, substantially in the vicinity of the front end 6 of the base 4. Between the ends 37, 38, the cable 36 follows each flange 12, 13 by moving away therefrom, in order to go around the rear support element 20 in a position that is further away from the flanges. An adjustable wedge 39, affixed to the rear support element 20 on the side of the free surface 27 thereof, makes it possible to adjust the angular position of the rear support element with respect to the base 4.

Figure 3:
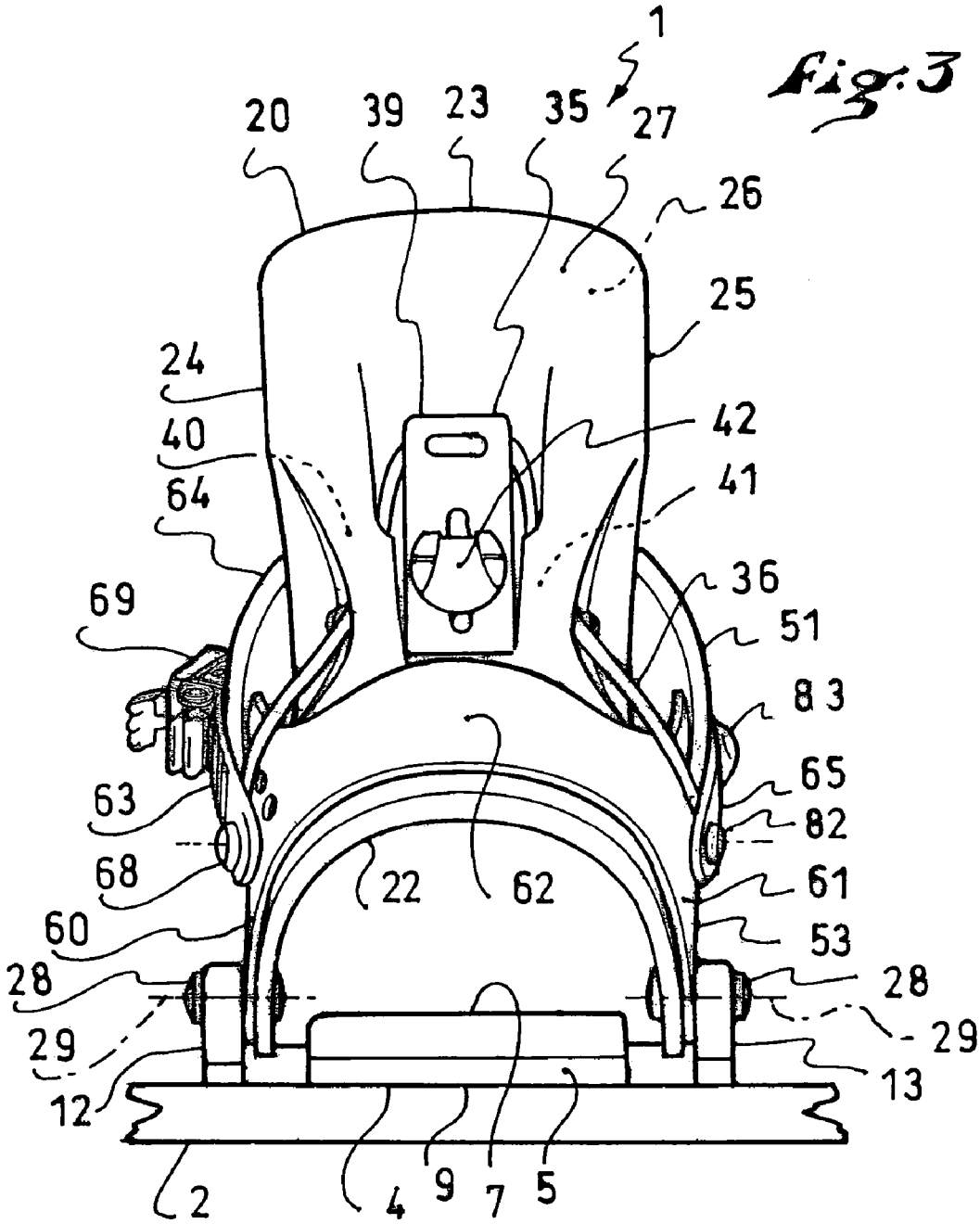
FIG. 3 is a rear view of the device of FIG. 1.

As shown in FIG. 3, the cable 36 extends through two guides 40, 41 of the rear support element 20 on both sides of the wedge 39. Between the guides 40, 41, the cable 36 is retained by the wedge 39. The wedge 39 can be brought closer to the free end 23, or moved away therefrom. To this end, any means known to the one with ordinary skill in the art is suitable. This means can have a screw 42 to tighten or loosen the wedge 39 in relation to the rear support element 20. Teeth complementary to the wedge 39 and to the rear support element 20 allow a positioning of one on the other. These teeth, not shown, are well-known to one of ordinary skill in the art.

Any other structure for providing the abutment could be suitable. For example, one could provide a connecting arch between the flanges 12, 13 on which the wedge 39 would take support. In this case, the use of a cable is not necessary.

Two linkages, or straps, are also provided for removably retaining the boot on the base 4, between the flanges 12, 13, in the receiving zone 14.

A first linkage 50 is located toward the front, in the area of the metatarsophalangeal articulation zone of the foot, when the foot is retained. A second linkage 51 is located toward the rear, in the area of the instep, when the foot is retained.

Each of the linkages 50, 51 extends transversely between the flanges 12, 13.

A number of different linkages could be provided.

According to the first embodiment of the invention, as seen in FIGS. 1 and 2, the second linkage 51 has a front part or section 52 and a rear part or section 53.

According to the invention, the front part 52 of the linkage 51 is located on the side of the support surface 26 of the rear support element 20, i.e., forward of the rear support element, and the rear part 53 is located on the side of the free surface 27 of the rear support element, i.e., rearward of the rear support element. This enables the second linkage to encircle the rear support element 20 at the same time as it retains the foot or boot; as shown in the illustrated embodiment, the front part 52 and the rear part 53 are connected to form a closed periphery. As a result of the encirling, the rear of the lower leg is always pressed against the support surface 26 of the rear support element 20. A resulting advantage is a direct transmission of the steering impulses while the lower leg is supported rearwardly.

Figure 4:
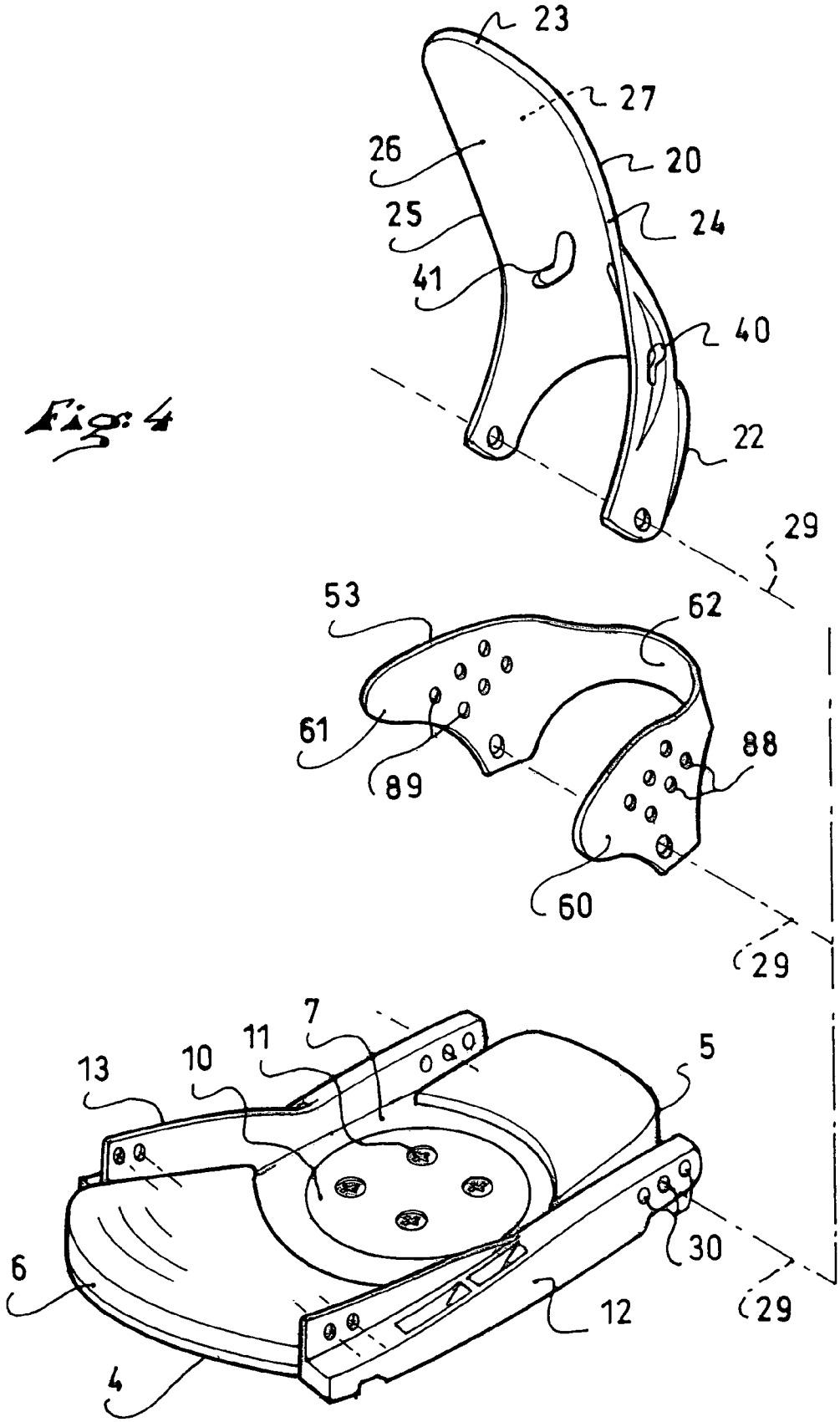
FIG. 4 is a perspective partial exploded view of the device of FIG. 1.

As shown clearly in FIG. 4, the rear part 53 of the linkage 51 has a lateral foot 60 and a medial foot 61 connected to one another by an arch 62. The lateral foot 60 and the medial foot 61 are associated with the lateral 12 and medial 13 flanges, respectively, by means of an articulation 28, for example, each articulation extending along an axis 29. Thus, the same articulation 28 serves to retain both the rear support element 20 and the rear part 53 of the linkage 51. A resulting advantage is a simplified construction. Another advantage is to impart to the rear part 53 a degree of rotational freedom along the transverse axis 29. This facilitates the positioning of the rear part 53. The arch 62 is more easily pressed on the free surface 27 of the rear support element 20.

It is contemplated, according to the invention, that the lateral foot 60, the medial foot 61, and the arch 62 form a unitary piece made from a synthetic material, for example. The rear part 53 of the linkage can include polyurethane, polyester, polyamide, or the like.

One can provide to give the rear part 53 of the linkage a relatively reduced thickness, for example, between 1 and 3 millimeters or between about 1 millimeter and about 3 millimeters. This makes it relatively flexible while allowing it to remain substantially inextensible. A resulting advantage is a better adaptability to the respective shapes of a boot or the rear support element.

The rear part of the linkage can also be constructed from a plurality of pieces assembled by any means known to one of ordinary skill in the art.

It is contemplated, according to the invention, that the rear support element 20 and the rear part 53 of the linkage can be connected to the flanges 12, 13 along two different axes. To this end, off-entered holes 30 can be used.

Figure 5:
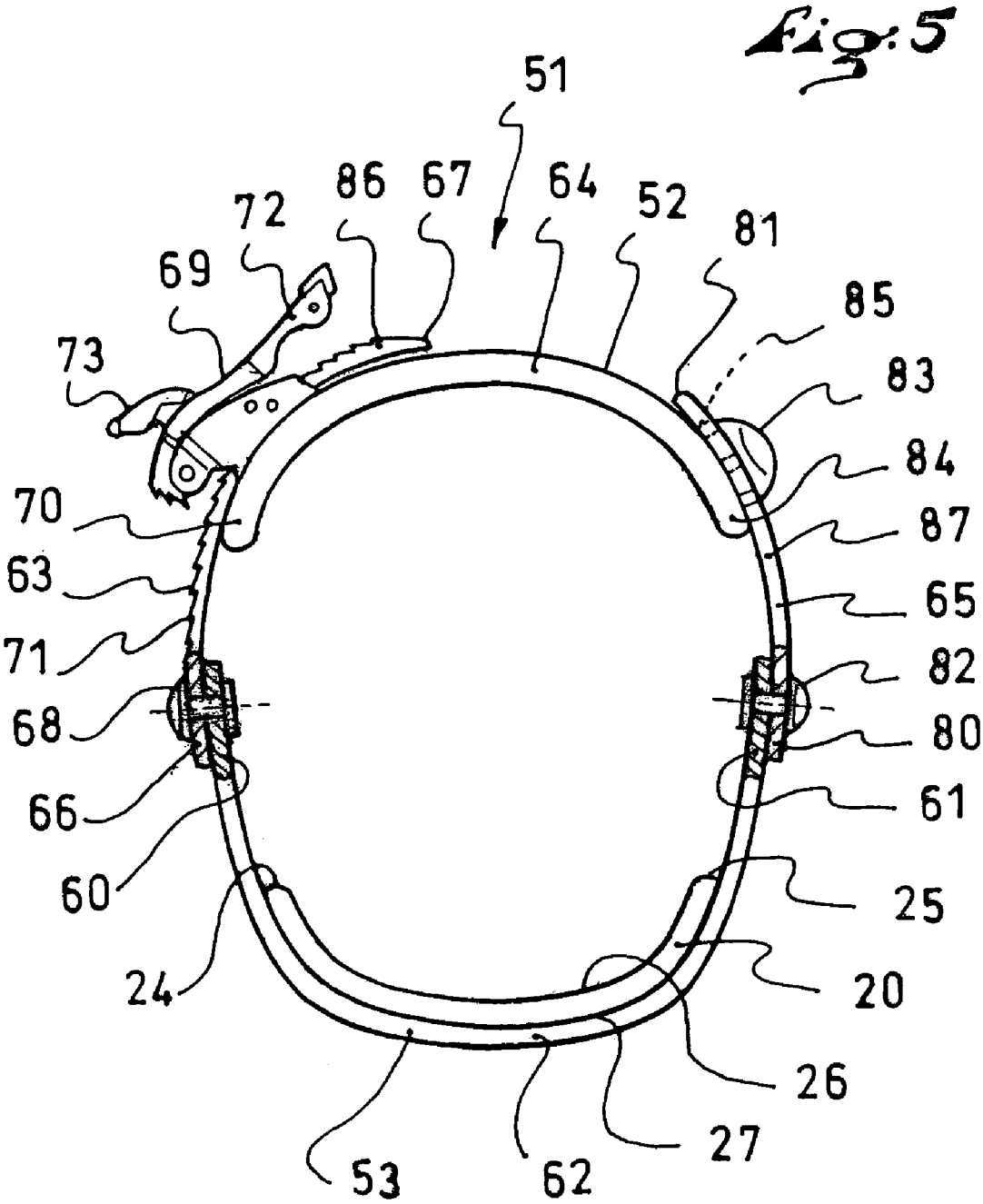
FIG. 5 is a cross-sectional view taken along the line V—V of PIG. 1.

The front part 52 of the linkage 51 is described by with reference to FIG. 5.

The front part 52 is associated with the rear part 53. It is shown in the form of an association of three portions, including a first fastening portion 63, a portion 64 for covering the boot, and a second fastening portion 65.

The first portion 63 has a fastening end 66 and a free end 67. The fastening end 66 is connected to the lateral foot 60 by a lateral fastener. The latter is shown as an articulation in the form of a rivet 68, for example.

A first connecting arrangement is provided to connect the covering portion 64, removably, to the first fastening portion 63, the free end 67 of the first fastening portion 63 being above the covering portion 64. This first connecting arrangement includes, for example, a ratchet tightening mechanism 69 attached to the covering portion 64, in the area of a first end 70 of the latter. The arrangement for connecting the covering portion 64 to the first fastening portion 63 also has a series of teeth 71 configured on the first fastening portion 63. The teeth 71 are distributed from the free end 67 up to the vicinity of the articulation 68.

By acting on a lever 72 of the mechanism 69, it is possible to tighten the front part 52 by bringing the first end 70 closer to the lateral foot 60. By acting on a button 73 of the ratchet tightening mechanism 69, one can loosen the front part 52, or even open it. In the latter case, the covering portion 64 and the first fastening portion 63 are separated.

Other arrangements could be provided, alternatively, to connect the covering portion 64 to the first fastening portion 63.

The second fastening portion 65 has a fastening end 80 and a free end 81. The fastening end 80 is connected to the medial foot 61 by a medial fastener. The latter is shown as an articulation, for example, in the form of a rivet 82.

A second connecting arrangement is provided to connect the covering portion 64 adjustably to the second fastening portion 65, the free end 81 of the second fastening portion 65 being above the covering portion 64. This arrangement has, for example, a screw 83 that is screwed into the covering portion 64, in the area of a second end 84 of the latter. The screw 83 extends through one of the holes 85 that extend through the second fastening portion 65.

Thus, the user can cause the second end 84 of the covering portion 64 to be in the vicinity of the medial foot 61. The adjustment of the position of the covering portion 64 with respect to the second fastening portion 65 is rarely modified. It is provided to take into account the boot space requirement.

The two articulations are positioned substantially along a transverse axis of the device, which enables the front part 52 to uniformly cover the boot.

The articulations could take other forms, such as screws, pins, or the like.

Similarly, the fastenings of the front part 52 to the rear part 53 of the linkage 51 could be made by other arrangements, such a winding about a keeper, or the like.

The front part 52 is substantially inextensible in the direction of its length, i.e., from one foot to the other. The materials of which it is comprised are selected to this end. In particular, the first and second fastening portions 63, 65 can have an elongated band 86, 87, respectively, that is made of a synthetic material, such as polyamide or polyurethane, reinforced or non-reinforced. Each band 86, 87 extends lengthwise from the fastening end 66, 80 to the free end 67, 81 of the fastening portion 63, 65, respectively.

The covering portion 64 also has an elongated form. It extends lengthwise between the first 70 and second 84 portions.

Each portion 63, 64, 65 is more or less flexible. Its curvature is variable, and it can bend in order to adapt to the foot or to the boot.

As shown clearly in FIG. 4, various holes 88, 89 are provided in the lateral foot 60 and medial foot 61, respectively. These holes 88, 89 make it possible to modify the relative positions of the front front part 52 and the rear part 53 of the linkage 51. A lateral 68 or medial 82 fastener can be assigned to a selected lateral 88 or medial 89 hole. A resulting advantage is an improvement to the adaptation of the device 1 to the size or shape of a boot. In the end, it is the entire linkage 51 that is pressed on the boot and on the rear support element 20. Thus, the play between the boot and the base 4 or the rear support element 20 is very small, or non-existent.

Additional embodiments of the invention are described hereinafter with reference to FIGS. 6–8. For reasons of simplification, only the particularities of these examples are shown.

Figure 6:
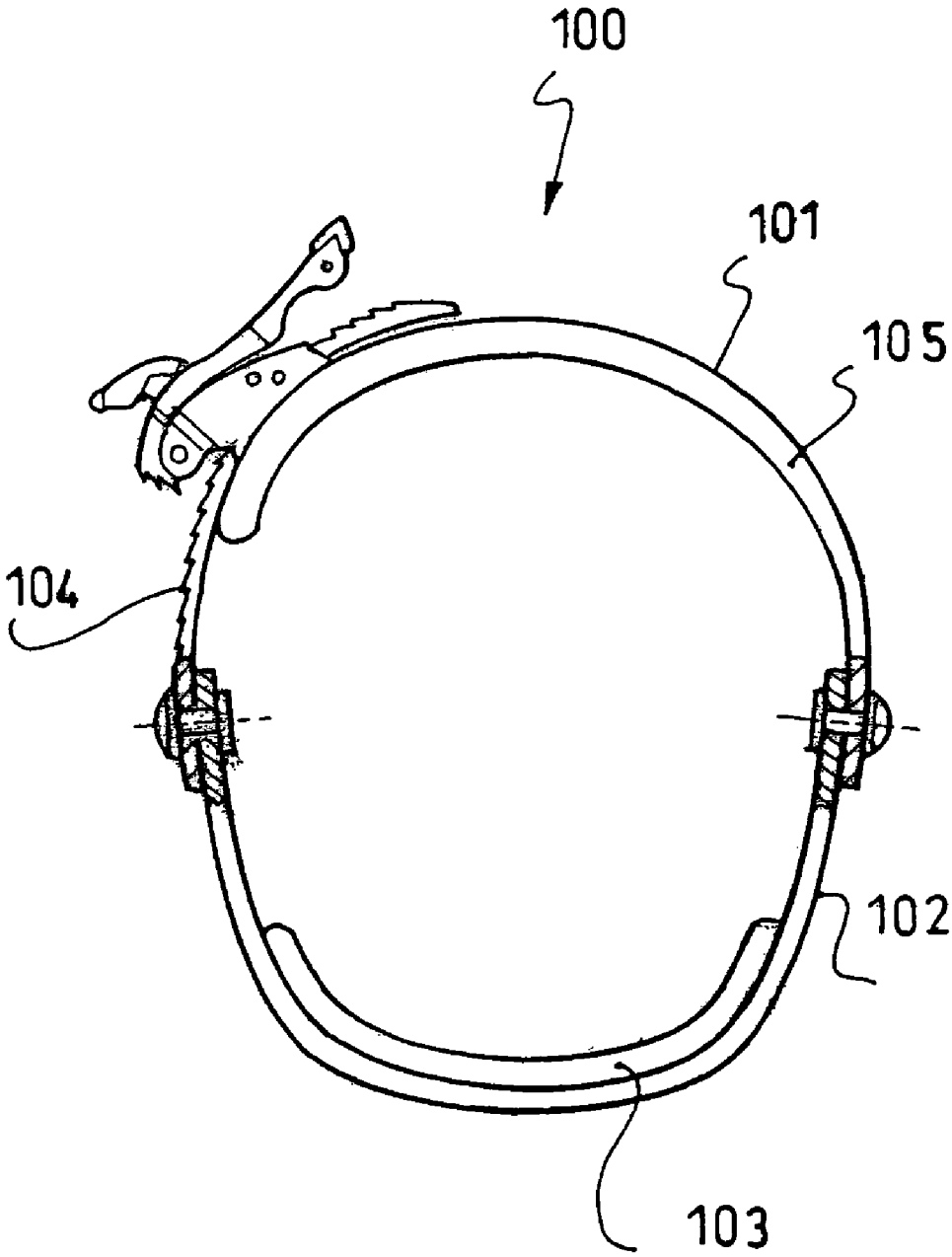
FIG. 6 is similar to FIG. 5 for a second embodiment of the invention.

The second embodiment is shown in FIG. 6. A rear linkage 100 is shown therein in cross-section in a manner similar to FIG. 5. The rear linkage 100 has a front section or part 101 and a rear section or part 102, the latter passing behind a rear support element or highback 103.

With respect to the first, the second embodiment calls for a reduced front portion 101. The front portion 101 has a smaller number of pieces for covering the boot. Indeed, it only has a first fastening portion 104 and a covering portion 105, excluding any other portion. This construction is simpler and more economical.

Figure 7:
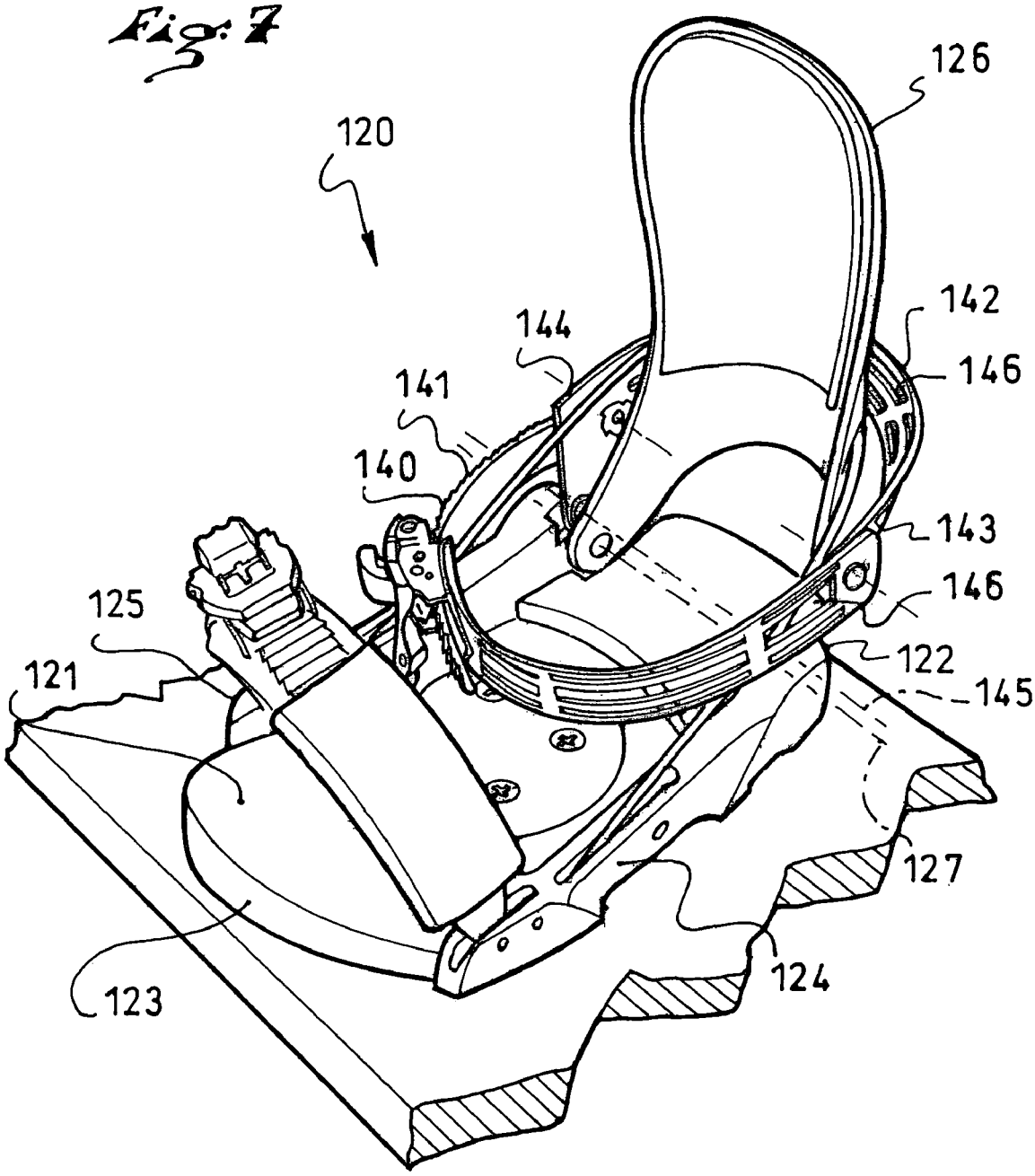
FIG. 7 is a perspective front view of a retaining device according to a third embodiment of the invention.
Figure 8:
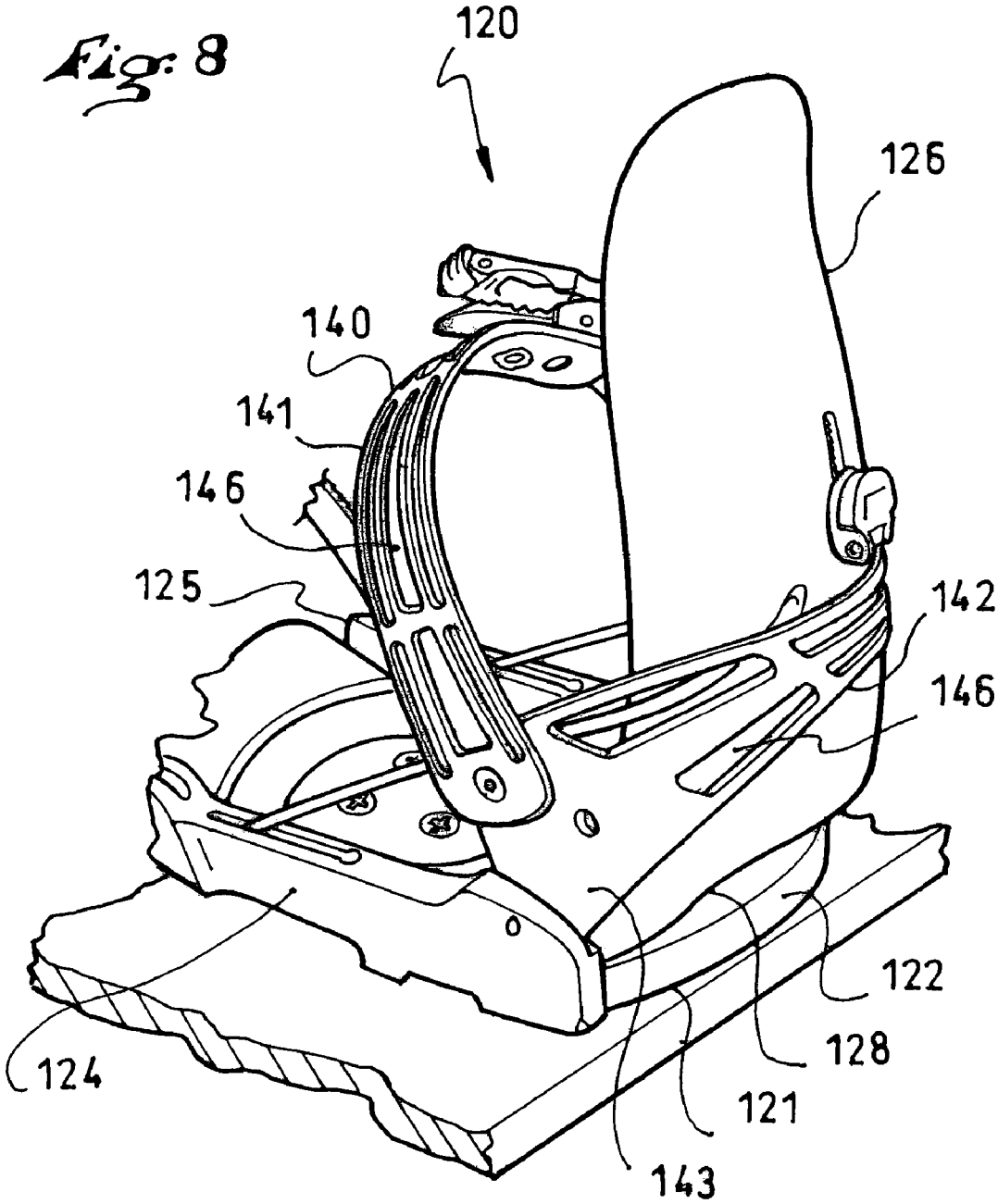
FIG. 8 is a perspective partial rear view of the device of FIG. 7.

The third embodiment is shown in FIGS. 7 and 8. A retaining device 120 has a base 121 that extends longitudinally between a rear end 122 and a front end 123. The base 121 is laterally bordered by a lateral flange 124 and a medial flange 125. A rear support element 126 of the device 120 is associated with the base 121 by means of an articulation having an axis 127. This articulation is positioned between a fastening end 128 of the rear support element 126 and the flanges 124, 125.

Furthermore, the device 120 has a rear linkage 140 with a front section or part 141 and a rear section or part 142. The rear part 142 has a lateral foot 143 and a medial foot 144, both associated with the base 121. The association is provided in the form of an articulation, along an axis 145, of the lateral foot 143 and the medial foot 144 on the lateral 124 and medial 125 flanges.

The articulation axes 127, 145 of the rear support element 126 and of the rear linkage 140 here are therefore different. This makes it possible to adjust the angular position of the rear support element 126 independently of the position of the rear linkage 140.

In a non-limiting manner, it is provided that the articulation axis 127 of the rear support element 126 is closer to the base 121 than the articulation axis 145 of the rear linkage 140. As a result, for the same tightening force of the linkage 140, the rear part 142 turns through an angle that is greater than that of the rear support element 126. A resulting advantage is a greater stability of the angular position of the rear support element 126.

Furthermore, it is provided that at least one of the parts 141, 142 of the linkage 140 have at least one pierced portion. The latter thus has openings 146 which make it lighter and provide it with a certain capability to deform in torsion. An advantage resulting from this characteristic is a better adaptation to the form of the boot. The open portion can be fitted with one or more shock absorbing cushions.

Figure 9:
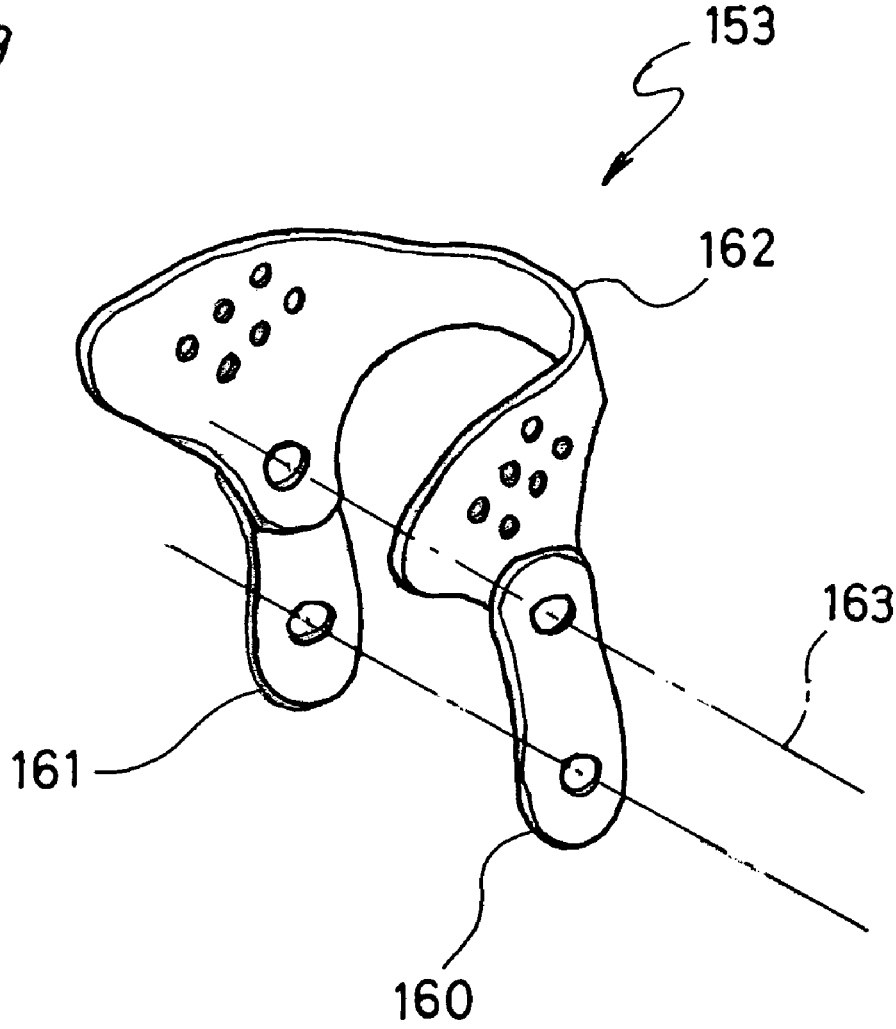
FIG. 9 is a perspective view of the rear section of a linkage according to a fourth embodiment of the invention.

The fourth embodiment is shown in FIG. 9. A rear section or part 153 of a linkage has a lateral foot 160 and a medial foot 161 connected by an arch 162. The lateral foot 160 and the medial foot 161 are articulated relative to the arch 162 along a transverse axis 163. The relative articulation of the feet 160, 161 and of the arch 162 moves the degree of rotational freedom of the arch toward the top, in a direction away from the base.

Generally speaking, the invention is made from materials and according to techniques of implementation that are known to those with ordinary skill in the art.

The invention is not limited to the particular constructions described hereinabove, and includes all technical equivalents that fall within the scope of the claims that follow.

In particular, it can be provided that the front part of a linkage be directly associated with the base, and that the rear part be connected to the front part.

It can also be provided that each of the front and rear parts be associated with the base.

In any case, the association can be direct or indirect.

Furthermore, each part can have flexible or rigid portions. In this latter case, the portions can be articulated with respect to one another in the manner of chain linkages.

What is claimed is:

1. A device for retaining a foot or a boot on an apparatus, said device comprising:

a lateral portion and a medial portion demarcating a receiving zone for receiving the foot or the boot;

a rear support element connected at least with one of the lateral and medial portions, the rear support element including a support surface facing the receiving zone and a free surface opposite the support surface;

a linkage extending between the lateral and medial portions, the linkage having a front part and a rear part;

the front part of the linkage being positioned in an area nearer the support surface of the rear support element, and the rear part being positioned in an area nearer the free surface of the rear support element.

2. A retaining device according to claim 1, wherein:

a lateral flange and a medial flange constitute the lateral portion and the medial portion, respectively;

the rear part of the linkage having a lateral foot, a medial foot, and an arch, the lateral foot and the medial foot being connected to one another by the arch, the lateral foot and the medial foot being associated, respectively, with the lateral flange and the medial flange.

3. A retaining device according to claim 1, wherein:

the front part comprises three portions, said three portions including a first fastening portion, a covering portion, and a second fastening portion.

4. A retaining device according to claim 1, wherein:

the front part comprises two portions, said two portions including a first fastening portion and a covering portion.

5. A device for retaining a foot or a boot on an apparatus, said device comprising:

a lateral portion and a medial portion demarcating a receiving zone for receiving the foot or the boot;

a rear support element connected at least with one of the lateral and medial portions, the rear support element including a support surface facing the receiving zone and a free surface opposite the support surface;

a linkage extending between the lateral and medial portions, the linkage having a front part and a rear part;

the front part of the linkage being positioned in an area nearer the support surface of the rear support element, and the rear part being positioned in an area nearer the free surface of the rear support element;

the front part being directly affixed to the rear part.

6. A device for retaining a foot or a boot on an apparatus, said device comprising:

a lateral portion and a medial portion demarcating a receiving zone for receiving the foot or the boot;

a rear support element connected at least with one of the lateral and medial portions, the rear support element including a support surface facing the receiving zone and a free surface opposite the support surface;

a linkage extending between the lateral and medial portions, the linkage having a front part and a rear part;

the front part of the linkage being positioned in an area nearer the support surface of the rear support element, and the rear part being positioned in an area nearer the free surface of the rear support element;

both the rear support element and the rear part of the linkage being connected to at least one of the lateral and medial portions by means of a same articulation.

7. A retaining device according to claim 1, wherein:

the rear support element and the rear linkage are associated with the lateral portions and the medial portions, respectively, by articulations having axes, the articulation axes of the rear support element and of the rear linkage being different.

8. A retaining device according to claim 1, further comprising:

an abutment positioned to limit rearward rotation of the rear support element, the abutment having a cable extending around the rear support element, the cable having a lateral end and a medial end, each of the ends being affixed at least to the lateral portion or to the medial portion.

9. A retaining device according to claim 1, further comprising:

a base.

10. A linkage adapted to be integrated within a device for retaining a foot or a boot, the device including a rear support element for supporting a lower leg of the user, the linkage comprising:

a front part and a rear part, both of the front and rear parts adapted to be separate from the rear support element;

the rear part of the linkage having a lateral foot, a medial foot, and an arch, the lateral foot being connected to the medial foot by means of the arch;

the front part being connected to the rear part, the front part adapted to extend over an instep region of the foot or boot and the rear part adapted to extend rearward of the rear support element.

11. A device for retaining a foot or a boot on an apparatus, said device comprising:

a lateral portion and a medial portion demarcating a receiving zone for receiving the foot or the boot;

a rear support element connected at least with one of the lateral and medial portions, the rear support element having a front side and a rear side, the front side including a support surface facing the receiving zone and the rear side including a free surface opposite the support surface;

a linkage extending between the lateral and medial portions, the linkage having a front part and a rear part;

the front part of the linkage extending between the lateral and medial portions forward of the front side of the rear support element so as to be positioned in an area nearer the support surface of the rear support element than the free surface of the rear support element, and the rear part of the linkage extending between the lateral and medial portions rearward of the rear side of the rear support element so as to be positioned in an area nearer the free surface of the rear support element than the support surface of the rear support element.

12. A snowboard binding comprising:

a base adapted to be affixed to an upper surface of a snowboard for supporting a snowboard boot;

a lateral flange extending along a lateral portion of the base and extending upwardly from the base, and a medial flange extending along a medial portion of the base and extending upwardly from the base, said base and said flanges forming a receiving zone for the snowboard boot;

a highback articulated to both the lateral and medial flanges for enabling forward and rearward pivotal movement of the highback relative to the lateral and medial flanges, said highback adapted to support a rear of a lower leg of a user;

a linkage for pressing the lower leg of the user against a front support surface of the highback, the linkage encircling the highback, the linkage comprising:

a front part adapted to extend over an instep region of the snowboard boot; and a rear part adapted to extend behind a rear of the snowboard boot.

13. A snowboard binding according to claim 12, wherein:

said rear part of the linkage is connected to said lateral and medial flanges by means of respective articulations enabling pivotal movement of the rear part of the linkage with respect to the lateral and medial flanges.

14. A snowboard binding comprising:

a base adapted to be affixed to an upper surface of a snowboard for supporting a snowboard boot:

a lateral flange extending along a lateral portion of the base and extending upwardly from the base, and a medial flange extending along a medial portion of the base and extending upwardly from the base, said base and said flanges forming a receiving zone for the snowboard boot;

a highback articulated to both the lateral and medial flanges for enabling forward and rearward pivotal movement of the highback relative to the lateral and medial flanges, said highback adapted to support a rear of a lower leg of a user;

a linkage for pressing the lower leg of the user against a front support surface of the highback, the linkage encircling the highback, the linkage comprising:

a front part adapted to extend over an instep region of the snowboard boot;

a rear part adapted to extend behind a rear of the snowboard boot, said rear part of the linkage being connected to said lateral and medial flanges by means of respective articulations enabling pivotal movement of the rear part of the linkage with respect to the lateral and medial flanges;

said highback being articulated to the lateral and medial flanges with the said articulations of the rear part of the linkage.

* * * * *